US008979521B2

(12) United States Patent
Kondo

(10) Patent No.: US 8,979,521 B2
(45) Date of Patent: Mar. 17, 2015

(54) SLOT NOZZLE ASSEMBLY AND SHIM PLATE

(75) Inventor: Koichi Kondo, Saitama-ken (JP)

(73) Assignee: Nordson Corporation, Westlake, OH (US)

( * ) Notice: Subject to any disclaimer, the term of this patent is extended or adjusted under 35 U.S.C. 154(b) by 125 days.

(21) Appl. No.: 13/403,477

(22) Filed: Feb. 23, 2012

(65) Prior Publication Data

US 2012/0219657 A1 Aug. 30, 2012

(30) Foreign Application Priority Data

Feb. 28, 2011 (JP) ..... 2011-42024

(51) Int. Cl.
*B05C 5/02* (2006.01)
*B05C 11/10* (2006.01)

(52) U.S. Cl.
CPC ..... *B05C 11/1002* (2013.01); *B05C 5/0254* (2013.01)
USPC ..... 425/376.1; 425/192 R; 425/461

(58) Field of Classification Search
CPC .. B05C 5/0254; B05C 5/0258; B05C 5/0262; B05C 5/0266; B05D 1/265
USPC ..... 425/192 R, 376.1, 461
See application file for complete search history.

(56) References Cited

U.S. PATENT DOCUMENTS 3,320,634 A * 5/1967 Ryan et al. ..... 425/190
4,299,186 A * 11/1981 Pipkin et al. ..... 118/407
2012/0027942 A1* 2/2012 Joos ..... 427/421.1

* cited by examiner

*Primary Examiner* — Yogendra Gupta
*Assistant Examiner* — Joseph Leyson
(74) *Attorney, Agent, or Firm* — Wood, Herron & Evans, L.L.P.

(57) ABSTRACT

A slot nozzle assembly for extruding a fluid material includes a slot for extruding a fluid material, a plurality of material exit ports, and a plurality of material dispersion passages communicating with the slot and the plurality of material exit ports, respectively. The widths of the plurality of material dispersion passages in the longitudinal direction of the slot widen from the plurality of material exit ports toward the slot for extruding a fluid material essentially uniformly in the longitudinal direction of the slot.

9 Claims, 5 Drawing Sheets

SLOT NOZZLE ASSEMBLY AND SHIM PLATE

TECHNICAL FIELD

The present invention relates to a nozzle assembly for extruding a fluid material, and to a shim plate used in a slot nozzle assembly.

BACKGROUND ART

A slot coat gun with a slot nozzle assembly is a contact or non-contact application device that extrudes a fluid material onto a substrate in a filmlike or stripelike manner. A slot coat gun can apply a fluid material thinly and broadly on the face of Kraft paper, high-quality paper, mold release paper, polyethylene film, non-woven fabric, etc., and so is used for manufacturing Kraft bags, adhesive tape and labels, hygienic articles, etc.

A slot coat gun can be used for applying a foam melt material to a substrate (Patent Document 1).

The slot nozzle assembly of a slot coat gun that extrudes a foam melt material has a shim plate. Herein below, a slot nozzle assembly 41 that has a conventional shim plate 44 shall be described with reference to the attached drawings.

FIG. 6 is an exploded perspective view of a conventional slot nozzle assembly 41. FIG. 7 is a vertical cross-section view of the conventional slot nozzle assembly 41 taken along line VII-VII in FIG. 6. FIG. 8 is a drawing showing the shim plate 44 that is attached to a conventional rear nozzle block 43.

The conventional slot nozzle assembly 41 comprises a front nozzle block 42, the rear nozzle block 43, and the shim plate 44, which is disposed between the front nozzle block 42 and the rear nozzle block 43.

The front nozzle block 42 is provided with a plurality of foam melt material passages 45. The plurality of foam melt material passages 45 respectively communicate with a plurality of material entrance ports 45*a* provided in the upper face of the front nozzle block 42 and a plurality of material exit ports 45*b* provided in the rear face of the front nozzle block 42.

The shim plate 44 is provided with a plurality of material passage holes 44*a* and a shim opening 44*b* that is a rectangular cutout. When the shim plate 44 is incorporated in the slot nozzle assembly 41, the plurality of material exit ports 45*b* of the front nozzle block 42 respectively face the plurality of material passage holes 44*a* of the shim plate 44. The foam melt material flows from the material exit ports 45*b* and into the material passage holes 44*a* of the shim plate 44.

The rear nozzle block 43 is provided with a plurality of material vertical groove passages 46 and a single common horizontal groove passage 48. When the rear nozzle block 43 is incorporated in the slot nozzle assembly 41, the plurality of material passage holes 44*a* of the shim plate 44 respectively face the upper part of the plurality of material vertical groove passages 46 of the rear nozzle block 43. The foam melt material flows from the material passage holes 44*a* of the shim plate 44 and into the material vertical groove passages 46 of the rear nozzle block 43.

The slot 49 is demarcated by the shim opening 44*b* of the shim plate 44, the rear face of the front nozzle block 42, and the front face of the rear nozzle block 43.

The foam melt material is supplied from a control module (not shown in the drawing) to the material entrance ports 45*a* of the front nozzle block 42. The foam melt material passes through the material passages 45 of the front nozzle block 42 and flows from the material exit ports 45*b* into the material passage holes 44*a* of the shim plate 44. Then the foam melt material flows from the material passage holes 44*a* into the vertical groove passages 46 of the rear nozzle block 43.

The foam melt material that flowed into the vertical groove passages 46 flows into the common horizontal groove passage 48, and then flows into the slot 49. Ultimately, the foam melt material is extruded from an exit port 50 of the slot nozzle assembly 41. The foam melt material that is extruded from the exit port 50 foams, and forms a broad striplike foam layer 56 on a substrate 55 that is being conveyed in conveyance direction X.

PRIOR ART DOCUMENTS

Patent Document 1

Patent Document 1: JP 2009-22867 A

SUMMARY OF THE INVENTION

Problems the Invention is to Solve

The above-mentioned conventional slot nozzle assembly 41 has the following problems.

FIG. 9 is an explanatory drawing showing the flow of the foam melt material at the shim opening 44*b* of the conventional shim plate 44, i.e. at the slot 49, and the foam layer 56 that is applied to the substrate (coated object) 55.

As shown in FIG. 9, the vertical flow VF of the foam melt material downward in a vertical groove passage 46 flows into the common horizontal groove passage 48 and divides into partial flows PF to the left and right and a direct flow DF to the shim opening 44*b* therebelow. The partial flows PF of the foam melt material that flowed from adjacent vertical groove passages 46 into the common horizontal groove passage 48 meet one another and collide at midway points MP in the common horizontal groove passage 48 between adjacent vertical groove passages 46. Two partial flows PF that collide and meet change to a downward direction, and become a collision flow CF. The collision flow CF flows slowly, and the flow quantity is small. Therefore, some of the gas dissolved in the foam melt material foams prematurely at the collision flow CF.

Some of the partial flows PF flowing through the common horizontal groove passage 48 are dispersed at a slant downward as dispersed flows DSF. The flow quantity and flow speed of a collision flow CF and a dispersed flow DSF are comparatively small.

On the other hand, the flow quantity and flow speed of a direct flow DF are comparatively large. The collision flows CF, dispersed flows DSF, and direct flows DF flow into the shim opening 44*b*, i.e. into the slot 49. By the time these flows reach the exit port 50, the difference in their flow speeds is comparatively reduced. However, the speed of their flows does not become uniform by the time their flows reach the exit port 50.

Also, the flow speed of the foam melt material adjacent to both side edges 44*c* of the shim opening 44*b* (slot 49) becomes slower than the flow speed at the center of the shim opening 44*b* due to the resistance of the side edges 44*c*. Therefore, premature foaming of the foam melt material occurs at both side edges 44*c* of the shim opening 44*b*.

The differences in the flow quantities and flow speeds of these flows make the thickness of the foam layer 56 formed on the substrate 55 be nonuniform. The foam layer 56 includes a thick-layer portion 56*a* formed mainly by a direct flow DF almost directly beneath the vertical groove passage 46 and a thin-layer portion 56*b* formed mainly by a collision flow CF and a dispersed flow DSF between adjacent vertical groove passages 46. Part of the thin-layer portion 56*b* is a layer with poor foaming, and includes melt material that foamed prematurely. The diameter of bubbles formed in the interior of the thin-layer portion 56*b* is comparatively large. The diameter of bubbles formed in the thick-layer portion 56*a* is smaller than the diameter of bubbles formed in the thin-layer portion 56*b*. As a result, the thin-layer portion 56*b* appears as a plurality of bands, separated from one another, in the longitudinal direction of the slot 49. These bands lower the quality of the product, and also worsen the appearance of the product.

Therefore, the object of the present invention is to provide a slot nozzle assembly that can extrude a fluid material essentially uniformly in the longitudinal direction of the slot.

Means for Solving the Problems

In order to solve the previously described problems, the present invention is the following sort of slot nozzle assembly.

Specifically, it is a slot nozzle assembly for extruding a fluid material, and has a slot for extruding the aforementioned fluid material, a plurality of material exit ports, and a plurality of material dispersion passages communicating with the aforementioned slot and the aforementioned plurality of material exit ports respectively; the widths of the aforementioned plurality of material dispersion passages in the longitudinal direction of the aforementioned slot widen from the aforementioned plurality of material exit ports toward the aforementioned slot.

Effect of the Invention

A slot nozzle assembly in accordance with the present invention can extrude a fluid material essentially uniformly in the longitudinal direction of the slot.

BEST MODE FOR CARRYING OUT THE INVENTION

Preferred embodiments of the present invention will be described hereinbelow with reference to the accompanying drawings. However, the dimensions, materials, shape, relative dispositions, and so forth of the constituent components described in the following embodiments do not limit the scope of the present invention to themselves alone, unless specifically indicated otherwise.

In these embodiments, the terms front, rear, above, and below are used for description, and do not limit the present invention. The directions indicated by front, rear, above, and below may be changed to correspond to the orientation of the slot nozzle assembly when it is attached to a device.

Embodiment 1

Figure 1:
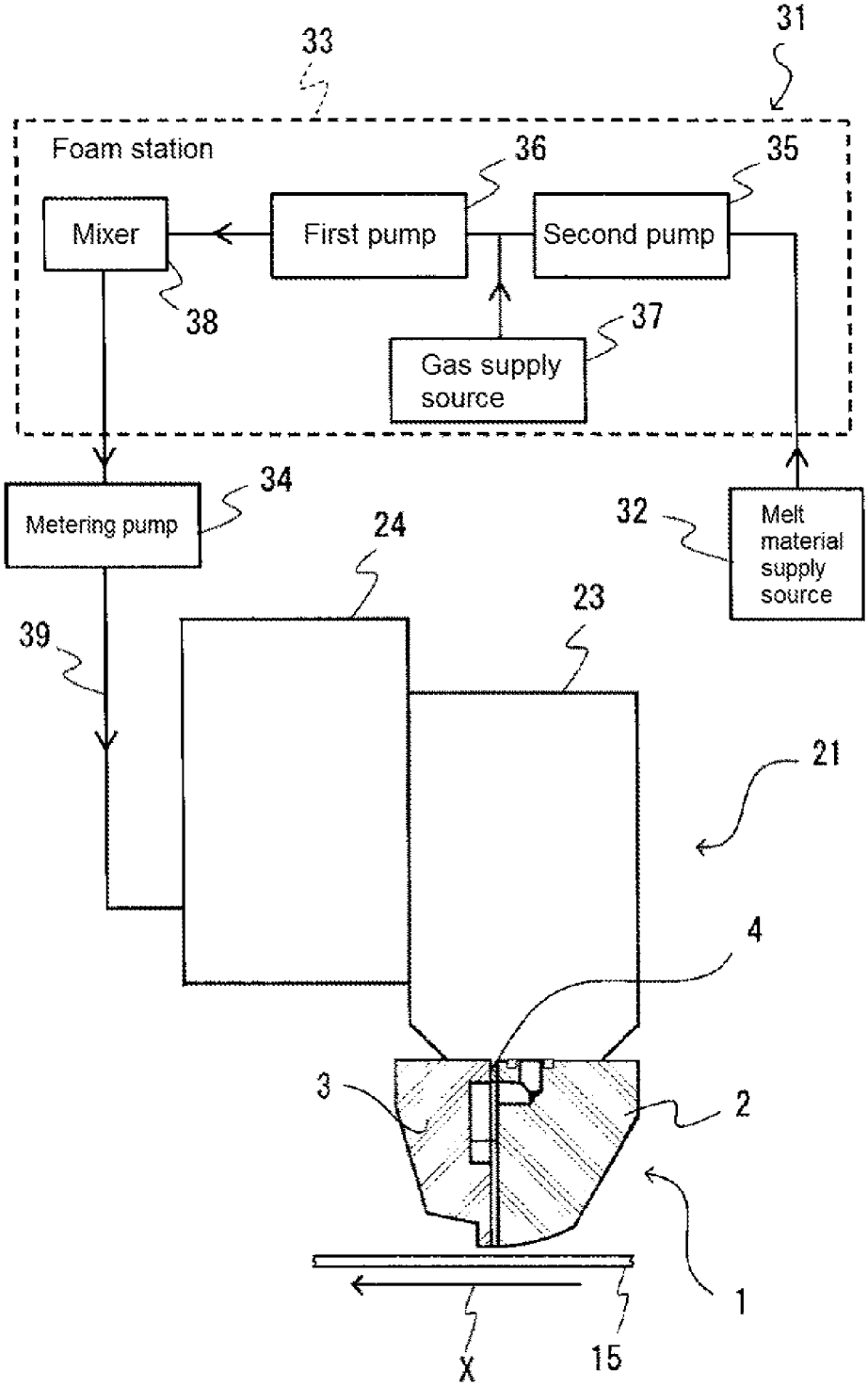
FIG. 1 is a drawing showing an embodiment in accordance with the present invention, including a slot coat gun and a system for supplying a foam melt material.

FIG. 1 is a drawing showing an embodiment in accordance with the present invention, including a slot coat gun and a system for supplying a foam melt material.

A slot coat gun 21 comprises a slot nozzle assembly 1, a control module 23, and a gun main body 24. The slot nozzle assembly 1 extrudes the foam melt material (fluid material). A broad flat substrate (coated object) 15, below the slot nozzle assembly 1, is conveyed in the direction indicated by arrow X, and touches or does not touch the slot nozzle assembly 1.

The slot nozzle assembly 1 comprises a front nozzle block 2, a rear nozzle block 3, and a shim plate 4 disposed between the front nozzle block 2 and the rear nozzle block 3. The front nozzle block 2 is positioned at the upstream side of the substrate 15 in conveyance direction X. The rear nozzle block 3 is positioned at the downstream side of the substrate 15 in conveyance direction X.

The gun main body 24 is supplied with the foam melt material from a foam melt material supply system 31. A cartridge heater (not shown in the drawing) and a temperature sensor (not shown in the drawing) are provided at the gun main body 24. The foam hot material passes through the gun body 24 and is sent to the control module 23.

An opening/closing valve (not shown in the drawing) is provided at the control module 23. The opening/closing valve allows and blocks the flow of material inside a material passage (not shown in the drawing) provided inside the control module 23. When the opening/closing valve is open, the foam melt material flows to the slot nozzle assembly 1. When the opening/closing valve is closed, the flow of foam melt material to the slot nozzle assembly 1 is blocked.

The foam melt material supply system 31 comprises a melt material supply source 32, a foam station 33, and a metering pump 34.

The melt material supply source 32 comprises a tank and a heater for melting a solid or semi-solid polymeric substance inside the tank. The melt material inside the tank is supplied to the foam station 33.

The foam station 33 makes the foam melt material by mixing a gas (dry air, nitrogen gas, carbon dioxide, etc.) into the polymer substance melt material. The foam melt material is kept in a mixture state (liquid state) as long as it is kept at a pressure equal to or higher than the critical pressure at which the gas dissolved in the melt material begins to foam. When the foam melt material is exposed to atmospheric pressure, the gas is generated from the melt material in the form of small bubbles, a foam body is formed, the bubbles expand, and the volume swells.

The foam station 33 comprises a first pump (gear pump) 35, a second pump (gear pump) 36, a gas supply source 37, and a mixer 38. The first pump 35 pressurizes and sends the melt material from the melt material supply source 32 to the second pump 36. The gas supply source 37 introduces a gas into the melt material between the first pump 35 and the second pump 36. The gas from the gas supply source 37 is introduced to the melt material by providing a difference in flow quantities between the first pump 35 and the second pump 36. The mixer 38 receives from the second pump 36 the melt material into which gas has been introduced, mixes the gas in the melt material, and makes the foam melt material. The foam melt material from the mixer 38 is supplied to the gun main body 24 of the slot coat gun 21 from the metering pump 34 via a hose 39.

Figure 2:
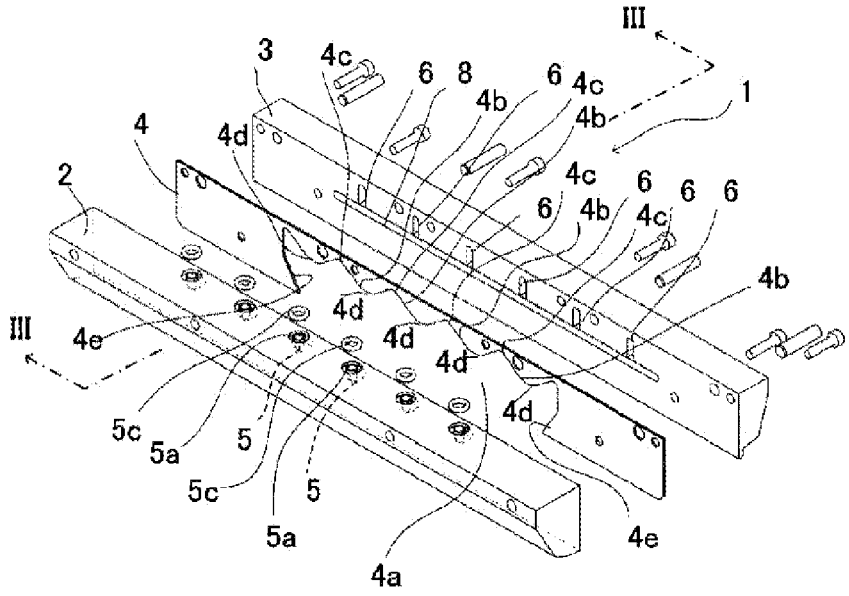
FIG. 2 is an exploded perspective view of the slot nozzle assembly of the present invention.
Figure 3:
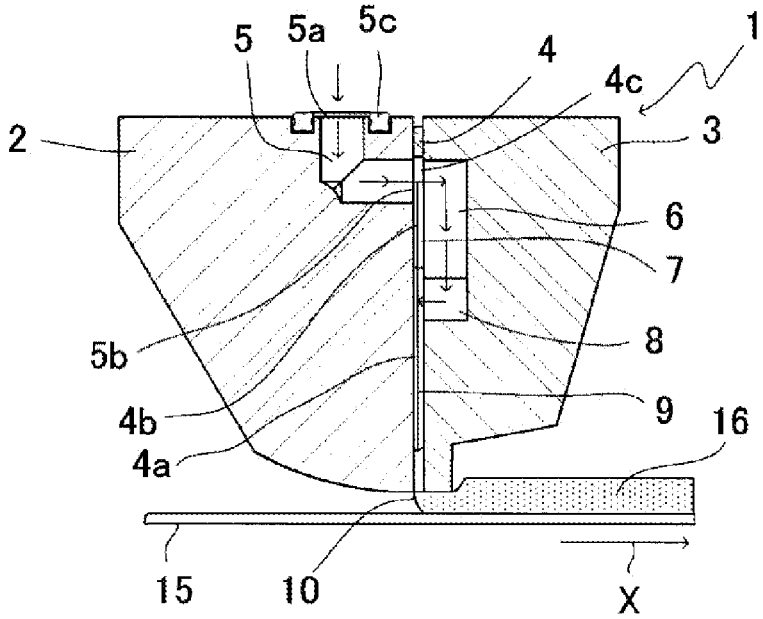
FIG. 3 is a vertical cross-section view of the slot nozzle assembly of the present invention.

FIG. 2 is an exploded perspective view of the slot nozzle assembly 1 of the present invention. FIG. 3 is a vertical cross-section view of the slot nozzle assembly 1 of the present invention taken along line III-III in FIG. 2.

The slot nozzle assembly 1 comprises a front nozzle block (first nozzle block) 2, a rear nozzle block (second nozzle block) 3, and a shim plate 4 disposed between the front nozzle block 2 and the rear nozzle block 3.

The front nozzle block 2 is provided with a plurality of foam melt material passages 5. The plurality of foam melt material passages 5 respectively communicate with a plurality of material entrance ports 5*a* provided in the upper face of the front nozzle block 2 and a plurality of material exit ports 5*b* provided in the rear face of the front nozzle block 2. The plurality of foam melt material passages 5 are respectively connected to a plurality of control module 23 material passages (not shown in the drawing). The foam melt material is supplied from the material passages of the control module 23 to the material entrance ports 5*a* of the foam melt material passages 5 of the front control block 2. Seal members 5*c* for preventing leakage of the foam melt material from the material entrance ports 5*a* are disposed between the front nozzle block 2 and the control module 23. The foam melt material flows from the plurality of material exit ports 5*b* to the interior of the slot nozzle assembly 1.

The shim plate 4 is provided with a shim opening (cutout) 4*a* that opens downward at the lower side. The upper edge of the shim opening 4*a* is formed in a wave shape. Specifically, a plurality of mountain-shaped cutouts 4*b* are formed, continuous in the width direction of the shim plate 4, at the upper side of the shim opening 4*a*. The plurality of mountain-shaped cutouts 4*b* communicate with the shim opening 4*a*. The respective widths of the plurality of mountain-shaped cutouts 4*b* in the width direction of the shim plate 4 widen from the peak 4*c* toward the direction of the exit port of the shim opening 4*a*. The width direction of the shim plate 4 is the direction orthogonal to the substrate 15 conveyance direction X when the shim plate 4 is incorporated in the slot nozzle assembly 1. The width direction of the shim plate 4 is the longitudinal direction of the slot 9.

Figure 4:
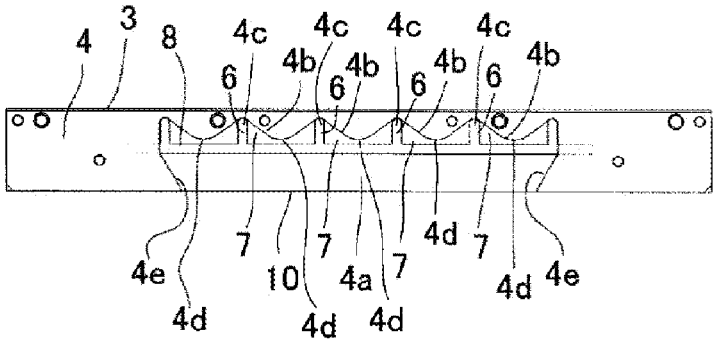
FIG. 4 is a drawing showing a shim plate attached to the rear nozzle block of the present invention.

The peak 4*c* of the mountain-shaped cutout 4*b* faces the material exit port 5*b* of the front nozzle block 2 when the shim plate 4 is incorporated in the slot nozzle assembly 1 as shown in FIG. 3. Also, the peak 4*c* is disposed at a position facing the peak of the vertical groove passage 6 of the rear nozzle block 3 as shown in FIG. 4, to be described later. The respective plurality of mountain-shaped cutouts 4*b* of the shim opening 4*a* form material dispersion passages 7 which widen downward to disperse the foam melt material toward the exit port 10 of the slot nozzle assembly 1. The material dispersion passages 7 communicate with the material exit ports 5*b* and the slot 9, and the width of the material dispersion ports 7 widens from the material exit ports 5*b* toward the slot 9. Specifically, the respective widths of the plurality of material dispersion passages 7 in the longitudinal direction of the slot 9 widen from the respective plurality of material exit ports 5*b* toward the slot 9.

The connecting portion of neighboring mountain-shaped cutouts 4*b* is formed as a valley 4*d* having the desired angle and radius of curvature.

The two side edges (inward slanted parts) 4*e* in the width direction of the shim opening 4*a* are slanted to the inside toward the lower part of the opening. Specifically, the two side edges 4*e* are slanted so that the width of the shim opening 4*a* become smaller going toward the exit port 10. The two side edges 4*e* function as a squeeze. Since the two side edges 4*e* are slanted inward toward the exit port 10, the width of the slot 9 in the longitudinal direction of the slot 9 becomes a taper that narrows toward the exit port.

The rear nozzle block 3 is provided with a plurality of material vertical groove passages 6 which face the plurality of material exit ports 5*b* of the front nozzle block 2 when incorporated in the slot nozzle assembly 1. Also, the rear nozzle block 3 is provided with a single common horizontal groove passage (open hole) 8 communicating with the plurality of material vertical groove passages 6. The plurality of material vertical groove passages 6 allow the plurality of material exit ports 5*b* to respectively communicate with the common horizontal groove passage. The common horizontal groove passage 8 is provided between the plurality of material exit ports 5*b* and the slot 9, and extends parallel to the longitudinal direction of the slot 9. The plurality of material dispersion passages 7 communicate with the common horizontal groove passage 8. In this embodiment, the common horizontal groove passage 8 is provided adjacent to the slot 9.

The slot 9 is demarcated by the shim opening 4*a* of the shim plate 4, the rear face of the front nozzle block 2, and the front face of the rear nozzle block 3. The longitudinal direction of the slot 9 is the width direction orthogonal to the relative movement direction between the slot nozzle assembly 1 and the substrate 15 (in this embodiment, conveyance direction X).

By opening the opening/closing valve of the control module 3 [sic], the foam melt material is supplied to the material entry ports 5*a* of the front nozzle block 2. The foam melt material passes through the material passages 5 of the front nozzle block 2 and flows from the material exit ports 5*b* into the peaks 4*c* of the mountain-shaped cutouts 4*b* of the shim plate 4. The foam melt material that flowed into the peaks 4*c* is dispersed and widens downward. Most of the foam melt material flows into the material dispersion passages 7 which widen downward at the mountain-shaped cutouts 4*b*. Some of the foam melt material flows into the vertical groove passages 6 of the rear nozzle block 3. The foam melt material that flowed into the plurality of vertical groove passages 6 flows into the single common horizontal groove passage 8. The foam melt material that flows out from the common horizontal groove passage 8 flows into the slot 9 together with the foam melt material that flowed out from the downward-widening material dispersion passages 7. The foam melt material passes through the slot 9 and is extruded from the exit port 10 of the slot nozzle assembly 1. The foam melt material extruded from the exit port 10 foams and forms a wide strip-like foam layer 16 on the substrate 15.

The hot melt material flowing in the interior of the slot 9 is pushed to flow toward the center of the shim opening 4*a* by the two side edges 4*e* of the shim opening 4*a*; this prevents the flow speed of the foam melt material at the perimeter of the two side edges 4*e* from being slowed. As a result, it is possible to prevent premature foaming of the hot melt material at the perimeter of the two side edges 4*e*. In this embodiment, the flow speed of the hot melt material at the perimeter of the two side edges 4*e* is essentially not slowed compared to the flow speed of the hot melt material at the center part in the longitudinal direction of the shim opening 4*a*.

According to this embodiment, different flows such as the collision flow CF, the dispersion flow DSF, and the direct flow DF seen in a conventional slot nozzle assembly occur almost not at all.

Figure 5:
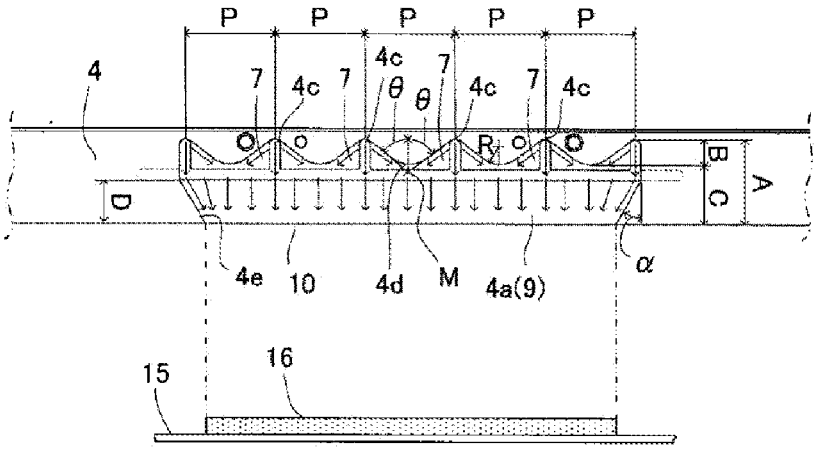
FIG. 5 is an explanatory drawing showing the flow of the foam melt material at the opening of the shim plate of the present invention, i.e. at the slot of the slot nozzle, and the foam layer that is applied to the substrate.
Figure 6:
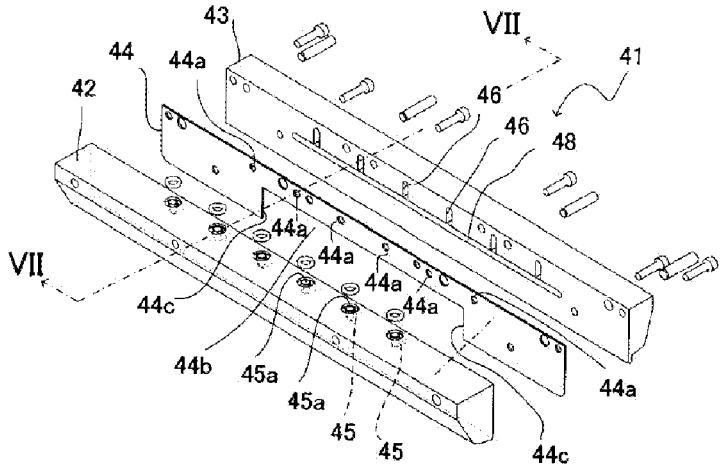
FIG. 6 PRIOR ART
FIG. 6 is an exploded perspective view of a conventional slot nozzle assembly.
Figure 7:
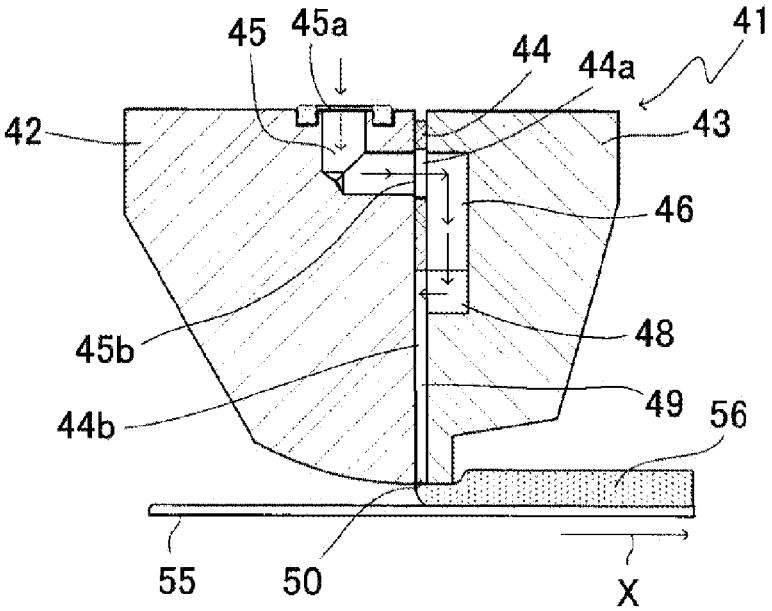
FIG. 7 PRIOR ART
FIG. 7 is a vertical cross-section view of a conventional slot nozzle assembly.
Figure 8:
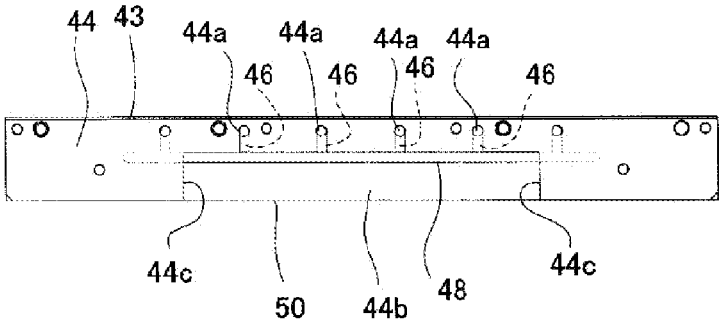
FIG. 8 PRIOR ART
FIG. 8 is a drawing showing a shim plate attached to a conventional rear nozzle block.
Figure 9:
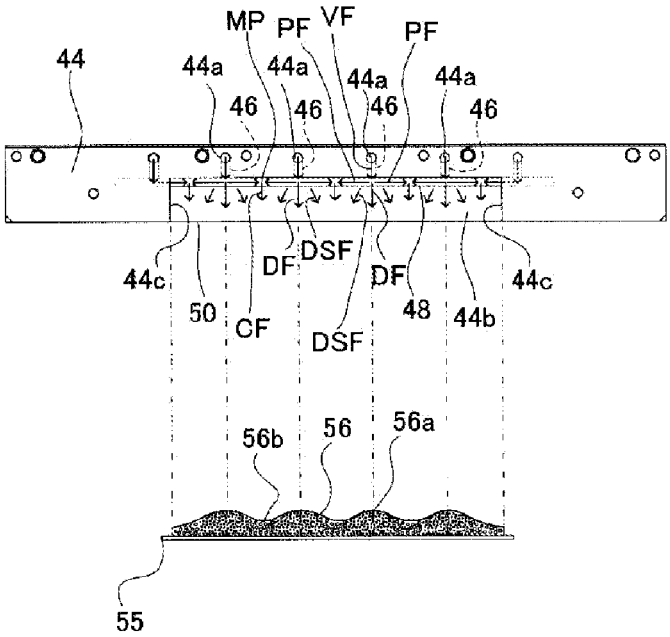
FIG. 9 PRIOR ART
FIG. 9 is an explanatory drawing showing the flow of the foam melt material at the opening of a conventional shim plate, i.e. at the slot of the slot nozzle, and the foam layer that is applied to the substrate.

According to this embodiment, because of the function of the plurality of downward-widening material dispersion passages 7 and the two side edges 4*e*, the foam melt material is uniformly dispersed in the longitudinal direction of the shim opening 4*a*, i.e. of the slot 9, as shown in FIG. 5, and the flow quantity, flow speed, and pressure distribution of the foam melt material in the longitudinal direction of the slot 9 are efficiently made uniform.

The foam melt material, uniformly dispersed inside the slot 9, is sent to the exit port 10 of the slot 9 and extruded from the slot 9. As a result of this, the foam melt material foams uniformly, and as shown in FIG. 5, forms a foam layer 16 that has a uniform thickness in the width direction of the substrate 15 on the substrate 15. Also, the diameter of bubbles in the interior of the foam layer 16 is small and uniform. As a result, bands are not created in the foam layer, as in the case of a conventional slot nozzle.

In addition, according to this embodiment, the plurality of downward-widening material dispersion passages 7 of the shim opening 4*a* are connected continuously in the longitudinal direction of the shim plate 4 (slot nozzle assembly 1), so length D from the entry port of the slot 9 to the exit port 10 can be made short. Therefore, it is possible to miniaturize the slot nozzle assembly 1.

In this embodiment, in order to effectively achieve the above-mentioned effects, various numerical limits such as the length ratio and angle and so forth pertaining to the shape of various components of the shim opening 4*a* are specified as follows.

These numerical limits establish appropriate ranges for keeping uniform the distribution, i.e. dispersion, of the foam melt material due to the shape of the plurality of downward-widening material dispersion passages 7 and the shim opening 4*a* that has the two inward-slanting side edges 4*e*, keeping the necessary pressure to prevent premature foaming inside the slot 9 (shim opening 4*a*), reducing the differences in flow quantity and pressure inside the slot 9, keeping to a minimum the occurrence of bands due to collision flow at conflux points M near the valleys 4*d* of the material dispersion passages 7, and making the length D of the slot 9 be small.

(1) The Foam Melt Material that is Used

Gas-containing hot melt

Viscosity: 10,000 cps to 100,000 cps

Temperature: 100° C. to 200° C.

Application amount of gas-containing hot melt supplied from the respective control modules 23 to the slot nozzle assembly 1: 30 cc/m$^2$ to 200 cc/m$^2$ (2-1)

Proper numerical ranges for various elements determining the shim opening shape for creating a small nozzle (setting the lower limit values and the upper limit values)

(2-1-1) P/A=1.25 or Less.

P is the separation between adjacent vertical groove passages 6 formed in the rear nozzle block 3. In this embodiment, the separation P between adjacent vertical groove passages 6 is equal. However, the separation P does not always have to be equidistant. For example, if the flow quantity of foam melt material supplied from the plurality of control modules 3 [sic] differs, the separation P may also be modified in accordance with the differing flow quantities.

A is the distance from the peak 4*c* of the shim opening 4*a* to the exit port 10.

In this embodiment, P/A is 1.06.

If the separation P is too large, the separation of the material exit ports 5*b* provided in the front nozzle block 2 widens, so the distribution of foam melt material worsens, and pressure differences inside the slot nozzle assembly 1 are likely to occur.

If the distance A is small, pressure inside the slot 9 drops. As a result, it is not possible to maintain the pressure inside the downward-widening material dispersion passages 7, and the foam melt material foams prematurely before the foam melt material supplied from the material exit ports 5*b* flows together at conflux point M (FIG. 5).

If the distance A is too long compared to the separation P, the length D of the slot 9 lengthens, so the dimensions of the slot nozzle assembly 1 itself become large.

If the separation P is small compared to the distance A, this achieves the same effect as increasing the number of material exit ports 5*b*. Specifically, the distribution of the foam melt material shifts toward becoming uniform. Therefore, the lower limit value for P/A approaches zero.

P/A is preferably 1.25 or less.

(2-1-2) B/A=0.2 to 0.7

B is the distance between the peak 4*c* of the mountain-shaped cutout 4*b* and the valley 4*d* formed in the shim opening 4*a*.

In this embodiment, B/A is 0.3.

If the distance A is too long compared to the distance B, the length D of the slot 9 lengthens, so the dimensions of the slot nozzle assembly 1 itself become large.

If the distance B is too long compared to the distance A, the distance from the material exit ports 5*b* to the conflux point M becomes long. As a result, the distance C from the valley 4*d* of the mountain-shaped cutout 4*b* to the exit port 10 shortens. If the distance C is too short, pressure inside the slot 9 drops. As a result, it is not possible to maintain the pressure inside the downward-widening material dispersion passages 7, and the foam melt material foams prematurely before the foam melt material supplied from the material exit ports 5*b* flows together at conflux point M.

B/A is preferably 0.2 to 0.7.

(2-1-3) P/B=1.8 to 6.25

In this embodiment, P/B is 3.57.

As P/B becomes smaller, the angle θ formed by the side connecting the peak 4*c* and the valley 4*d* of the mountain-shaped cutout 4*b* with respect to a vertical line becomes smaller, which smoothes the flowing together of the left and right flows at the conflux point M and makes it easier to prevent the occurrence of bands. However, if the distance B is too large, the distance from the material exit ports 5*b* to the conflux point M becomes long. As a result, the foam melt material foams prematurely before the foam melt material supplied from the material exit ports 5*b* flows together at conflux point M. In addition, if the distance B is too large, the distance C is too short, so pressure inside the slot 9 drops. As a result, it is not possible to maintain the pressure inside the downward-widening material dispersion passages 7, and the foam melt material foams prematurely before the foam melt material supplied from the material exit ports 5*b* flows together at conflux point M.

As P/B becomes larger, the angle θ becomes larger, and collision flow is likely to occur at the conflux point M. As a result, bands are likely to occur in the foam layer applied to the substrate.

Also, if the separation P is too large, the separation of the material exit ports 5*b* provided in the front nozzle block 2 widens, so the distribution of foam melt material worsens, and pressure differences inside the slot nozzle assembly 1 are likely to occur. As a result, the thickness of the foam layer applied to the substrate becomes nonuniform.

P/B is preferably 1.8 to 6.25.

Furthermore, the angle θ changes in accordance with the separation P and the distance B.

(2-1-4) R=5 to 20 mm

R is the radius of curvature of the valley 4*d*.

In this embodiment, the radius of curvature R is 10 mm.

When the radius of curvature R becomes small, the angle θ becomes small, and collision flow is likely to occur at the conflux point M.

If the radius of curvature R is too large, this leads to the foam melt material flowing perfectly laterally from the material exit ports 5*b*, and direct flows may collide with one another. This sort of collision flow is a factor in causing bands in the foam layer applied to the substrate.

The radius of curvature R is preferably 5 to 20 mm.

(2-1-5) C/A=0.3 to 0.8

In this embodiment, C/A is 0.7.

If C/A is too large, the angle θ becomes large, so collision flow is likely to occur at the conflux point M. As a result, bands are likely to occur in the foam layer applied to the substrate. On the other hand, if the distance C is large, the flow quantity and flow speed of the foam melt material are easily made uniform by the time the foam melt material arrives at the exit port, so it is easy to prevent the occurrence of bands. However, if the distance C is too large, the slot nozzle assembly becomes large, which is not desirable.

If C/A is small, the angle θ becomes small, which smoothes the flowing together of the left and right flows at the conflux point M and makes it easier to prevent the occurrence of bands. However, if the distance C is too small, pressure inside the slot 9 drops. As a result, it is not possible to maintain the pressure inside the downward-widening material dispersion passages 7, and the foam melt material foams prematurely before the foam melt material supplied from the material exit ports 5*b* flows together at conflux point M.

C/A is preferably 0.3 to 0.8.

(2-2) The proper numerical range for the inward slanting angle (squeeze slant angle) of side edge 4*e* in order to shift the flow of the foam melt material in the vicinity of the two width-direction side edges 4*e* in the shim opening 4*a* toward the center, and to prevent the flow speed of the foam melt material in the vicinity of the side edges 4*e* from being slower than the flow speed of the foam melt material at the center part α=10 to 40°

In this embodiment, the squeeze slant angle α is 31.35°.

If the squeeze slant angle α is too small, the flow speed of the foam melt material is likely to slow due to resistance by the two side edges 4*e* of the shim opening 4*a* in the same manner as prior art. Therefore, the thickness of the foam layer becomes thin at the two sides in the width direction of the foam layer.

If the squeeze slant angle α is too large, the length of the side edges 4*e* lengthens. Therefore, the flow speed of the foam melt material is likely to slow due to resistance by the lengthened side edges 4*e*. As in the case when the squeeze slant angle α is too small, the thickness of the foam layer becomes thin at the two sides in the width direction of the foam layer. Also, because of the lengthened side edges 4*e*, the foam melt material stagnates at both ends inside the slot.

The inward slanting angle α is preferably 10 to 40°.

Given conditions other than the above-mentioned numerical ranges, the distribution of the foam melt material inside the slot nozzle assembly worsens, bands occur in the foam layer applied to the substrate, and irregularities occur in the thickness of the foam layer.

In this embodiment, the present invention was described using a shim plate 4 in which a plurality of mountain-shaped cutouts 4*b* were continuously formed. However, the present invention is not limited to this. Instead of using a shim plate, it is possible to continuously form a plurality of mountain-shaped groove holes of the same sort as the mountain-shaped cutouts 4*b* in the front nozzle block 2 or in the rear nozzle block 3. The mountain-shaped groove holes may provide communication between the material exit ports 5*b* and the slot 9, and may be material dispersion passages whose longitudinal width widens from the material exit ports 5*b* toward the slot 9.

Also, it is possible to combine a nozzle block in which mountain-shaped groove holes are formed and a shim plate, and to make it possible to change the slot width, length, or thickness (separation) by replacing the shim plate.

By using shim plates with different thicknesses, it is possible to easily change the thickness (separation) of the slot in accordance with the application pattern for the foam layer. Therefore, it is possible to reduce costs when changing the application pattern.

If a plurality of material dispersion passages are formed in a nozzle block and a shim plate is not used, this achieves the effect of making it possible to prevent human errors such as mistakes in attaching the shim plate at the production site, etc.

According to this embodiment, it is possible to prevent the occurrence of bands of bubbles in the foam layer applied to the coated object.

According to this embodiment, it is possible to improve the flow quantity distribution, speed distribution, and pressure distribution of fluid material in the passages of the slot nozzle assembly.

According to this embodiment, it is possible to extrude a fluid material essentially uniformly in the width direction orthogonal to the relative movement direction between the slot nozzle assembly and the coated object.

According to this embodiment, it is possible to reduce collision flows by reducing the occurrence of flow in the width direction in the interior of the slot nozzle assembly. Therefore, a fluid material flows smoothly to the material dispersion passages and can achieve an essentially uniform flow speed distribution in the width direction. Therefore, it is possible to prevent the occurrence of bands in the foam layer due to premature foaming.

According to this embodiment, both side edges of the slot slant inward toward the center part going downward, so it is possible to prevent slowing of the flow speed of the fluid material at both side edges compared to the flow speed of the fluid material at the center part. Therefore, it is possible to make the application distribution of the fluid material be uniform in the longitudinal direction of the slot.

The slot nozzle assembly for extruding a fluid material in accordance with the present invention can be used for contact or non-contact applications overall, such as applying glue to labels, applying sealing agents, coating gaskets, etc.

The "foam melt material" in this specification is a compound made of a polymeric substance and a gas. For example, the foam melt material is a material with a gas such as air or nitrogen or carbon dioxide dissolved in unvulcanized rubber, saturated polyester, polyamide, polyolefin, or polyolefin copolymer or modified body thereof under pressure. At atmosphere pressure, the gas dissolved in the foam melt material foams and creates countless independent bubbles and the volume swells by approximately 1.5 to 5×.

In this embodiment, the present invention was described using a foam melt material, but the present invention can also be used for applying non-foaming fluid materials in addition to foam melt materials. Non-foaming fluid materials are hot melts and liquid materials, for example.

The present invention is not limited to the above embodiments. It can be practiced in various other configurations without departing from its characteristic matters. Therefore, the previously described embodiments are merely simple illustrative examples in every point, and are not to be interpreted as limiting. The scope of the present invention is as indicated by the claims, and is not restricted in any way by the specification text. In addition, variations and modifications that belong to the same scope as the claims are all within the scope of the present invention.

LEGEND

1 Slot nozzle assembly
2 Front nozzle block (first nozzle block)
3 Rear nozzle block (second nozzle block)
4 Shim plate
4*a* Shim opening
4*b* Mountain-shaped cutout
4*c* Peak
4*e* Side edge
5*b* Material exit port
6 Vertical groove passage
7 Material dispersion passage
8 Common horizontal groove passage
9 Slot

The invention claimed is:

1. A slot nozzle assembly for extruding a fluid material, comprising:

a slot for extruding said fluid material, a plurality of material exit ports, a plurality of material dispersion passages communicating with said slot and said plurality of material exit ports respectively;

said plurality of material dispersion passages having widths in the longitudinal direction of said slot that widen from said plurality of material exit ports toward said slot; and a plurality of mountain-shaped cutouts demarcating said plurality of material dispersion passages allowing said plurality of material exit ports to respectively communicate with said slot such that respective widths of said plurality of mountain-shaped cutouts in the longitudinal direction widen toward said slot, wherein said plurality of mountain-shaped cutouts define a first peak and a second peak widening toward said slot and to a valley between said first and second peaks, said valley having a radius of curvature between about 5 mm and about 20 mm for reducing a likelihood of collision flow of said fluid material flowing toward said slot.

2. The slot nozzle assembly of claim 1, wherein the assembly has a common horizontal groove passage provided between said slot and said plurality of material exit ports and communicating with said plurality of material dispersion passages.

3. The slot nozzle assembly of claim 1, wherein the assembly has a plurality of vertical groove passages respectively facing said plurality of material exit ports and communicating with said common horizontal groove passage.

4. The slot nozzle assembly of claim 1, wherein said slot is tapered and the width of said slot narrows toward an exit port of said slot.

5. The slot nozzle assembly of claim 1, wherein said slot nozzle assembly comprises a first nozzle block, a second nozzle block, a shim plate disposed between said first nozzle block and said second nozzle block, said plurality of material dispersion passages demarcated by said plurality of mountain-shaped cutouts formed in said shim plate, and said shim plate includes a shim opening in fluid communication with said mountain shaped cutouts.

6. The slot nozzle assembly of claim 1, wherein said slot nozzle assembly comprises a first nozzle block and a second nozzle block.

7. The slot nozzle assembly of claim 6, wherein said plurality of material dispersion passages are demarcated by a plurality of mountain-shaped cutouts formed in said first nozzle block or said second nozzle block.

8. The slot nozzle assembly of claim 5, wherein said shim opening includes side edges that slant inward so that a width of said shim opening becomes smaller going toward an exit port of said shim opening, and when said shim plate is incorporated in the slot nozzle assembly, peaks of said plurality of mountain-shaped cutouts are disposed facing said plurality of material exit ports of the slot nozzle assembly.

9. The slot nozzle assembly of claim 1, wherein said radius of curvature of said valley is about 10 mm.

* * * * *

UNITED STATES PATENT AND TRADEMARK OFFICE

CERTIFICATE OF CORRECTION

PATENT NO. : 8,979,521 B2
APPLICATION NO. : 13/403477
DATED : March 17, 2015
INVENTOR(S) : Koichi Kondo It is certified that error appears in the above-identified patent and that said Letters Patent is hereby corrected as shown below:

In the Specification

Column 6

Line 8, change “become” to --becomes--.

Line 27, change “3 [sic]” to --23--.

Column 7

Line 65, change “3 [sic]” to --23--.

Signed and Sealed this
Twenty-eighth Day of July, 2015

Michelle K. Lee

Michelle K. Lee
*Director of the United States Patent and Trademark Office*